United States Patent [19]

Megy et al.

[11] 4,105,469

[45] Aug. 8, 1978

[54] PROCESS FOR REGENERATING A PICKLE ACID BATH

[75] Inventors: Joseph Allen Megy, Corvallis; Richard Lee Propst, Scio, both of Oreg.

[73] Assignee: Teledyne Industries, Inc., Los Angeles, Calif.

[21] Appl. No.: 767,993

[22] Filed: Feb. 11, 1977

[51] Int. Cl.[2] ..... B08B 3/10

[52] U.S. Cl. ..... 134/3; 134/13; 134/41

[58] Field of Search ..... 134/13, 3, 41; 423/72, 423/82, 84, 85, 464

[56] References Cited

U.S. PATENT DOCUMENTS

| | | | |
|---|---|---|---|
| 2,743,160 | 4/1956 | Wainer | 423/72 |
| 2,812,237 | 11/1957 | Wainer | 423/72 |
| 3,048,503 | 8/1962 | Foote et al. | 134/13 X |

*Primary Examiner*—S. Leon Bashore
*Assistant Examiner*—Marc L. Caroff
*Attorney, Agent, or Firm*—Shoemaker and Mattare, Ltd.

[57] ABSTRACT

A HF-$HNO_3$ pickle acid bath for pickling zirconium, zirconium alloys, hafnium, and hafnium alloys is regenerated by adding to the spent pickle acid a sufficient amount of NaF to precipitate out, in the case of zirconium, $ZrF_4$ as $Na_2ZrF_6$. HF and $HNO_3$ are added to the bath to make up losses and the pickle acid is recycled for use.

5 Claims, 1 Drawing Figure

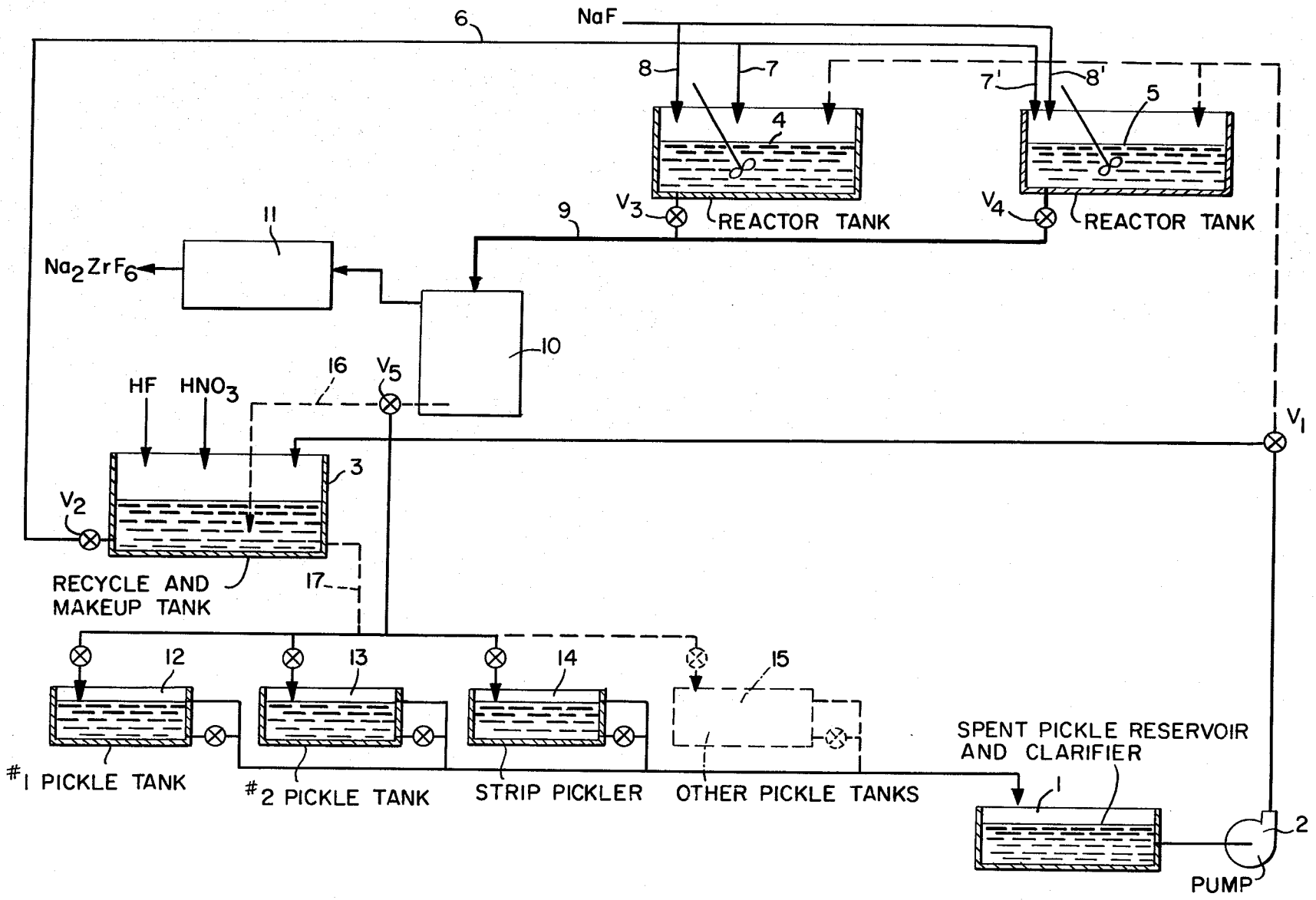
REACTOR TANK
REACTOR TANK
NaF
$V_1$
$V_2$
$V_3$
$V_4$
$V_5$
PUMP
SPENT PICKLE RESERVOIR AND CLARIFIER
OTHER PICKLE TANKS
STRIP PICKLER
#2 PICKLE TANK
#1 PICKLE TANK
RECYCLE AND MAKEUP TANK
HF
$HNO_3$
$Na_2ZrF_6$

PROCESS FOR REGENERATING A PICKLE ACID BATH

BACKGROUND OF THE INVENTION

1. Field of the Invention

This invention relates to a method for regenerating and recycling pickle acid used for cleaning zirconium, zirconium metal alloys, hafnium, and hafnium metal alloys. More specifically, this invention relates to a method of removing $ZrF_4$ from the spent pickle acid, using NaF to precipitate $Na_2ZrF_6$. The pickle acid is then bulked by adding HF and $HNO_3$ to the level required and recycled. The process steps and chemistry are the same for hafnium.

2. Description of the Prior Art

Basically what occurs in the process of pickling of zirconium and zirconium metal alloys is as follows: The pickle acid used for pickling zirconium and its alloys comprises HF and $HNO_3$. Of the two types of acid present in the pickle acid solution, only hydrofluoric acid reacts with the zirconium metal. Among other functions, the nitric acid primarily reacts with tin which is a common component in the zirconium alloy and also is a source of hydrogen ion which accelerates the HF attack. As the zirconium is eaten away by the HF, the tin is simultaneously removed by the $HNO_3$. If the $HNO_3$ was not present, a layer of tin would be left behind on the surface of the zirconium metal and the pickling reaction would be suppressed. Since tin is present in only very small amounts in zirconium alloys, the amount of $HNO_3$ consumed during the course of pickling is very low compared to the amount of HF consumed.

In terms of a chemical reaction, the following occurs during pickling: 4 HF molecules react with 1 Zr metal atom to form 1 $ZrF_4$ (zirconium fluoride) molecule and 2 hydrogen gas molecules, i.e.,

| | | | | |
|---|---|---|---|---|
| 4HF dissolved in pickle acid | + 1 Zr Zirconium metal | forms | 1 $ZrF_4$ this dissolves into the pickle acid and will be removed by the recovery process | + 2 $H_2$(gas) this bubbles out of the pickling acid during pickling |

At the time that a tank of pickle acid is spent and ready to be dumped, the following substances are present in the acid:

(1) Residual HF which has not been consumed by pickling.

(2) Nitric acid, a small fraction of which has been consumed.

(3) Dissolved $ZrF_4$ (zirconium fluoride).

(4) Other impurities such as dissolved tin which reacted with the nitric acid.

This spent pickle acid must be disposed of in some way since as it is it is unusable. This presents a pollution problem since it cannot be just dumped. Presently, the spent pickle acid is neutralized with lime. This requires a large expenditure for lime along with there being no saving of any acid.

It has been known to reclaim HF-$HNO_3$ pickle acid liquors by distillation or by precipitation with barium compounds. The first method disclosed in an article entitled "Mixed Acid Pickle Waste," *Metal Finishing*, May 1963, discloses a method of distilling HF-$HNO_3$ from a liquor which has heavy sulphuric acid additions. These pickling acid solutions resulted from the treatment of pickling steel. The distilling method presents problems in that pickle acid at high temperature is extremely corrosive and it is necessary to use protected equipment which is extremely expensive. This, along with the expense of the large amount of energy required for this process, prohibits its use in practice.

The barium salt method, which is disclosed in USAEC Document No. IDO-14511, is also an expensive method in that these barium salts are expensive. This method, however, produces a product which is not easily recyclable in that it has not as yet been determined if barium qualifies as an additive which may be present in the pickle acid during pickling.

It is apparent that there is a need in the zirconium and hafnium industry for an inexpensive, workable process for regeneration and recycling HF-$HNO_3$ pickle acid solutions.

BRIEF SUMMARY OF THE INVENTION

It is, accordingly, one object of the present invention to provide a new process for regenerating and recycling spent pickle acid used in the zirconium and hafnium industry.

Another object of the present invention is to provide a new process for regenerating spent HF-$HNO_3$ pickle acid which results in considerable savings in acid costs while solving a disposal problem of the spent pickle acid.

An additional object of the present invention is to provide a new process for regenerating spent HF-$HNO_3$ pickle acid whereby the $ZrF_4$ is precipitated out as a usable salt and the solution after being rejuvenated is capable of being recycled.

Still another object of the present invention is to provide a new process whereby $ZrF_4$ is precipitated from HF-$HNO_3$ pickle acid by the addition of sodium fluoride to the spent pickle acid.

Yet another object of the present invention is to provide a method whereby $ZrF_4$ is precipitated from a spent pickle acid solution as $Na_2ZrF_6$ which is usable for obtaining other products.

A still further object of the present invention is to provide an inexpensive process for regenerating spent HF-$HNO_3$ pickle acid capable of being recycled for pickling by merely adding small amounts of HF and $HNO_3$.

These and other advantages of the present invention will be apparent in the following description and drawing.

In accordance with the above objects, it has been found that spent HF-$HNO_3$ pickle acid from pickling zirconium or hafnium or their alloys can be regenerated by the addition of NaF to precipitate, in the case of zirconium, $ZrF_4$ as the $Na_2ZrF_6$ salt. The salt has uses in the making of zirconium-magnesium master alloys or it can be reduced to obtain therefrom the zirconium metal. The solution of pickle acid, either before or after the zirconium has been removed, is bulked to original acid concentrations by the addition of HF and $HNO_3$.

This inexpensive regeneration process solves the problem of disposal and pollution which needs no lime for neutralization but, to the contrary, produces usable products both in the precipitated salt and, of course, the pickle acid which is recycled for use.

DESCRIPTION OF THE PREFERRED EMBODIMENTS

The following detailed description deals exclusively with zirconium. It should be kept in mind, however, that the same process and chemistry holds for hafnium metals and their alloys.

Basically, the pickle acid recovery process involves the following:

(1) The addition of HF to make up for that amount of HF that was consumed during pickling.

(2) The infrequent addition of nitric acid when necessary to make up for the nitric acid consumed by the tin and some other alloy constiuents.

(3) Removal of the dissolved zirconium fluoride ($ZrF_4$) in the pickle acid.

The first two steps listed above can be performed either before or after the precipitation of zirconium fluoride which will be seen from the description of the drawing.

If the $ZrF_4$ is not removed, it will begin to accumulate in the pickle acid until it reaches a point when no more $ZrF_4$ will dissolve into the acid. At this point, it will begin to precipitate out on the surface of the zirconium metal being pickled. This is undesirable.

The $ZrF_4$ is removed by adding granulated sodium fluoride (NaF) crystals to the pickle acid. The sodium fluoride (NaF) dissolves into the pickle acid and reacts with the zirconium fluoride ($ZrF_4$) to form a fine crystal particle of sodium hexafluoro zirconate ($Na_2ZrF_6$), which can be filtered out of the pickle acid. The acid is then ready to be reused for pickling again.

When one is adding NaF (sodium fluoride) to remove $ZrF_4$, only the amount necessary to react with the $ZrF_4$ must be added. If there is excessive NaF in the pickle acid when it is returned to the pickle tanks, it will react with the $ZrF_4$ generated by the pickling process on the surface of the zirconium sheets forming sodium zirconium fluoride articles. This results in non-uniform pickling.

The addition of NaF is measured so as to precipitate $Na_2ZrF_6$ leaving 3–7gZr/l, thereby avoiding excess NaF in the spent liquor which would precipitate sodium zirconium fluoride in the pickling process as zirconium fluoride accumulated. If insufficient NaF is used, $NaZrF_5.H_2O$ forms a gel, which is difficult to filter. The precipitation and subsequent filtration of $Na_2ZrF_6$ is carried out at a lower temperature than the pickling process so that the residual NaF in equilibrium with the precipitated $Na_2ZrF_6$ before filtration will not precipitate $ZrF_4$ as it accumulates during the pickling process.

BRIEF DESCRIPTION OF THE DRAWING

As shown in the sole drawing, the spent pickle acid is stored and clarified in tank 1. It is then pumped by pump 2 to make up tank 3 by way of valve V1. Here HF is added to make up for that amount of acid used in pickling the zirconium and its alloys and, when necessary, $HNO_3$ is added to bring the solution up to the pickling concentration. From here the solution is pumped by way of valve V2 to reactors 4 and 5 by way of lines 6 and 7 and 7' where NaF is added by lines 8 and 8' to precipitated $ZrF_4$ as $Na_2ZrF_6$ in accordance with the following equation:

$$ZrF_4 + 2\ NaF \rightarrow Na_2ZrF_6$$

The solution containing the precipitate is then pumped through line 9 by way of valves V3 and V4 to filter 10 where the solution is separated from the precipitate. The precipitate is then dried in drier 11 and the solution is pumped by way of valve V5 to the pickle acid tanks 12, 13, 14, and 15.

As stated above, the spent pickle acid can be bulked to pickle concentration either before or after the precipitation of the $Na_2ZrF_6$. In the latter case, the spent pickle acid from tank 1 is pumped directly to reactor tanks 4 and 5 where NaF is added to precipitate $ZrF_4$ as $Na_2ZrF_6$. The solution containing the precipitate is then run through line 9 by way of valves V3 and V4 to filter 10. The precipitate is then dried in drier 11 and the solution of pickle acid is pumped by way of valve V5 and line 16 to make up tank 3 where HF and $HNO_3$, when necessary, are added to bring the pickle acid to pickling concentration. The pickle acid is then pumped to pickle tanks 12, 13, 14, and 15 by way of line 17.

The following runs were made in a pilot plant to illustrate the process. In these runs, six 700 liter batches of pickle acid were regenerated and returned to the pickle acid tank, where the HF content of the acid was adjusted to 2.0 N with concentrated HF. The regenerated pickle acid was as satisfactory as freshly prepared pickle acid for pickling zirconium alloys. The test data relative to these runs are illustrated in Table 1.

TABLE 1

| | Analysis Of Spent Pickle Acid | | | Regenerated Pickle Acid Returned To Pickle Tank |
|---|---|---|---|---|
| Sample | 26 Zr Analysis | F Analysis | NaF Added | Na Analysis |
| 1 | 28.3 g/l | — | 13.2 Kg | 1.0 g/l |
| 2 | 23.1 g/l | 0.640 N | 14.2 Kg | 0.9 g/l |
| 3 | 36.6 g/l | 0.405 N | 22.9 Kg | 1.8 g/l |
| 4 | 41.2 g/l | 0.380 N | 25.9 Kg | 1.9 g/l |
| 5 | 35.8 g/l | 1.78 N | 21.6 Kg | 1.7 g/l |
| 6 | 23.7 g/l | — | 14.8 Kg | 1.0 g/l |

As can be seen above, the amount of NaF added to precipitate $ZrF_4$ will vary depending on its concentration in the pickle acid, which will depend on to what extent it has been used. The extent of use will also determine what amount of make up acid is necessary to be added in each case. These conditions can be determined by testing the spent pickle acid for zirconium concentration, HF concentration, and total acid concentration, thus determining the necessary make up acid, and the amount of zirconium in the acid which will have to be precipitated out.

As previously stated, the detailed description relates solely to zirconium although all of the steps of the process are the same for regenerating the same pickle acid which has become spent from pickling hafnium metals and/or hafnium alloys. With regard to both metals, it is possible that the order of steps, as set forth above, can be varied in that the concentration of the acid should not interfer with the precipitation steps. Further, the number of tanks or the configuration of the plant can be varied to suit the particular needs. Thus, for instance, the solution can be filtered in various ways, the precipitation dried in various ways, etc.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the mete and bounds of the claims or that form their functional as well as conjointly cooperative equivalents are, therefore, intended to be embraced by those claims.

I claim:

1. In a process of pickling a metal selected from the group consisting of zirconium and zirconium alloys by contacting the metal with a HF-$HNO_3$ pickle acid, recovering spent pickle acid, regenerating the spent pickle acid, and subsequently recycling the regenerated acid for further pickling, the improvement comprising regenerating the spent pickle acid by adding thereto sodium fluoride in an amount sufficient to produce a pickle acid containing from 3–7gZr/l.

2. In a process of pickling a metal selected from the group consisting of zirconium and zirconium alloys by contacting the metal with a HF-$HNO_3$ pickle acid, recovering spent pickle acid, and subsequently regenerating the spent pickle acid, the improvement comprising bringing the spent pickle acid up to pickling concentration by adding HF and $HNO_3$ thereto and removing $ZrF_4$ from the spent pickle acid by adding a sufficient amount of NaF to precipitate the $ZrF_4$ as $Na_2ZrF_6$, said amount being that amount necessary to reduce the zirconium in solution to from 3–7gZr/l, filtering the acid containing said precipitate to remove the $Na_2ZrF_6$ and subsequently recycling the acid solution for further pickling.

3. The process of claim 1 wherein the spent pickle acid is brought up to pickle concentration by adding HF and $HNO_3$ thereto.

4. The process of claim 3 wherein the spent pickle acid is brought up to pickle concentration before the addition of sodium fluoride.

5. The process of claim 3 wherein the spent pickle acid is brought up to pickle concentration after the addition of sodium fluoride.

* * * * *